US008079334B2

(12) United States Patent
Park

(10) Patent No.: US 8,079,334 B2
(45) Date of Patent: Dec. 20, 2011

(54) CONTINUOUSLY VARIABLE VALVE ACTUATION SYSTEM

(75) Inventor: Byung Ok Park, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 351 days.

(21) Appl. No.: 12/536,289

(22) Filed: Aug. 5, 2009

(65) Prior Publication Data

US 2010/0154731 A1 Jun. 24, 2010

(30) Foreign Application Priority Data

Dec. 5, 2008 (KR) ..... 10-2008-0123665

(51) Int. Cl.
*F01L 1/34* (2006.01)

(52) U.S. Cl. ..... 123/90.16; 123/90.39; 123/90.44; 74/569

(58) Field of Classification Search ..... 123/90.16, 123/90.27, 90.31, 90.39, 90.44; 74/559, 74/567, 569
See application file for complete search history.

(56) References Cited

U.S. PATENT DOCUMENTS 6,886,512 B2 * 5/2005 Naumann ..... 123/90.39
* cited by examiner

*Primary Examiner* — Ching Chang
(74) *Attorney, Agent, or Firm* — Morgan, Lewis & Bockius LLP

(57) ABSTRACT

A continuously variable valve actuation (CVVA) system may include a driving cam rotated by a driving force transmitted from a crankshaft, and a driven cam pressed by the driving cam to be rotated around a first end thereof serving as a rotational axle of the driven cam, wherein the driven cam has a cam face at a second end thereof so as to press and open a valve when rotated, and wherein a vertical distance between the rotational axis of the first end of the driven cam and a rotational axis of the driving cam is configured to be adjusted by moving a position of the rotational axis of the first end of the driven cam.

8 Claims, 8 Drawing Sheets

CONTINUOUSLY VARIABLE VALVE ACTUATION SYSTEM

CROSS-REFERENCE TO RELATED APPLICATION

The present application claims priority to Korean Patent Application Number 10-2008-0123665 filed Dec. 5, 2008, the entire contents of which application is incorporated herein for all purposes by this reference.

BACKGROUND OF THE INVENTION

1. Field of the Invention

The present invention relates to continuously variable valve actuation (CVVA) system and, more particularly, to a CVVA system in which the lift time, the lift distance and the duration of a valve can be simultaneously varied depending on various conditions of an engine, particularly the low-speed/high-speed operating range of an engine.

2. Description of Related Art

As for an engine, a camshaft is rotated by a rotating force transmitted from a crankshaft, and an intake valve and an exhaust valve reciprocate up and down with regular timing by cams of the camshaft. Thereby, intake air is supplied to a combustion chamber, and combustion gas is exhausted. In this process, a fuel-air mixture is compressed and exploded to generate power.

At this time, a device that can continuously vary the lift distance of a valve according to an operating speed of the engine is called a continuous variable valve actuation (CVVA) system.

Hereinafter, a conventional CVVA system will be described in detail with reference to the attached drawings.

FIG. 1 is a schematic side view illustrating the configuration of a conventional CVVA system.

As illustrated in FIG. 1, the conventional CVVA system includes a driving cam 4 installed on a camshaft 2, a swing arm 12 swinging in contact with the driving cam 4, a driving arm 19 driving a valve 5 in cooperation with the swing arm 12, a variable arm 13 causing the driving arm 19 to pivot around a swing axle of the swing arm 12, an actuator driving the variable arm 13, and a cam means installed between the swing arm 12 and the driving arm 19.

The swing arm 12 and the variable arm 13 are supported on a common control shaft 10 so as to allow relative motion. The driving arm 19 is connected to the variable arm 13 at the base end thereof, and has a driving portion 20 driving a rocker arm 6 at the leading end thereof. Further, the cam means includes a cam face 15 formed on the swing arm 12, and a cam follower 22 supported on an intermediate portion of the driving arm 19, and is configured to change an initial position of the driving arm 19 with respect to the swing arm 12 by pivoting of the driving arm 19.

According to the aforementioned configuration of the conventional CVVA system, when the driving cam 4 is rotated in the counterclockwise direction at the position illustrated in FIG. 1, the end (particularly, the right-hand end) of the swing arm 12 rotates to move toward the driving arm 19. When the end of the swing arm 12 comes into contact with the driving arm 19, the rocker arm 6 is pressed, and thus the valve 5 is opened.

At this time, when the variable arm 13 is rotated in the counterclockwise direction at the position illustrated in FIG. 1, the intermediate portion of the driving arm 19 comes into contact with the rocker arm 6, and thus gets near the end of the swing arm 12. In this state, when the driving cam 4 is rotated, the end of the swing arm 12 presses the driving arm 19 earlier, so that the valve 5 has an earlier lift time and thus a longer lift distance.

Thus, the conventional CVVA system illustrated in FIG. 1 has an advantage in that the lift time and distance of the valve can be regulated depending on the speed of the engine.

However, the conventional CVVA system essentially requires the constituent parts of the swing arm 12, driving arm 19, variable arm 13, actuator 11, etc. in order to transmit the force of the driving cam 4 to the valve 5, so that the configuration thereof is complicated and the manufacturing costs thereof is increased.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a continuously variable valve actuation (CVVA) system which can simultaneously vary the lift time and the lift distance of a valve and has a simple structure.

In an aspect of the present invention, a continuously variable valve actuation system may include a driving cam rotated by a driving force transmitted from a crankshaft, and a driven cam pressed by the driving cam to be rotated around a first end thereof serving as a rotational axle of the driven cam, wherein the driven cam has a cam face at a second end thereof so as to press and open a valve when rotated, and wherein a vertical distance between the rotational axis of the first end of the driven cam and a rotational axis of the driving cam is configured to be adjusted by moving a position of the rotational axis of the first end of the driven cam.

The cam face may include a high lift section where the driven cam allows the valve to move more than a preset distance when rotated around the first end thereof, and a low lift section where the driven cam allows the valve to move down less than the preset distance when rotated around the first end thereof, wherein the high lift section has a midpoint farther from the rotational axle of the driven cam than that of the low lift section toward the driving cam.

In another aspect of the present invention, the continuously variable valve actuation system may further include an actuator configured to press the first end of the driven cam for adjusting a height of the first end of the driven cam such that the cam face contacting the valve is limited to one of the high lift section and the low lift section regardless of an rotational angle of the driven cam.

In further another aspect of the present invention, the continuously variable valve may further include a bracket wherein the driven cam includes a slide stub protruding from the rotational axle thereof and is slidably inserted into a slot formed on the bracket so as to limit a range within which a height of the driven cam is adjusted.

The driven cam may include a roller at a portion thereof which comes into contact with the driving cam.

The cam face may be curved inwards, and an upper end of the valve may be curved outwards at a part thereof which comes into contact with the cam face.

In another aspect of the present invention, the continuously variable valve actuation system may further include a contact block formed an upper portion of the valve, wherein the cam face is curved inwards and an upper end of the contact bracket is curved outwards at a part thereof which comes into contact with the cam face.

According to embodiments of the present invention, the lift time and distance of the valve can be simultaneously varied with neither a separate rocker arm for pressing the valve nor a separate variable cam for regulating the lift time of the valve, and thus the CVVA system has a very simple structure and reduces manufacturing costs.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
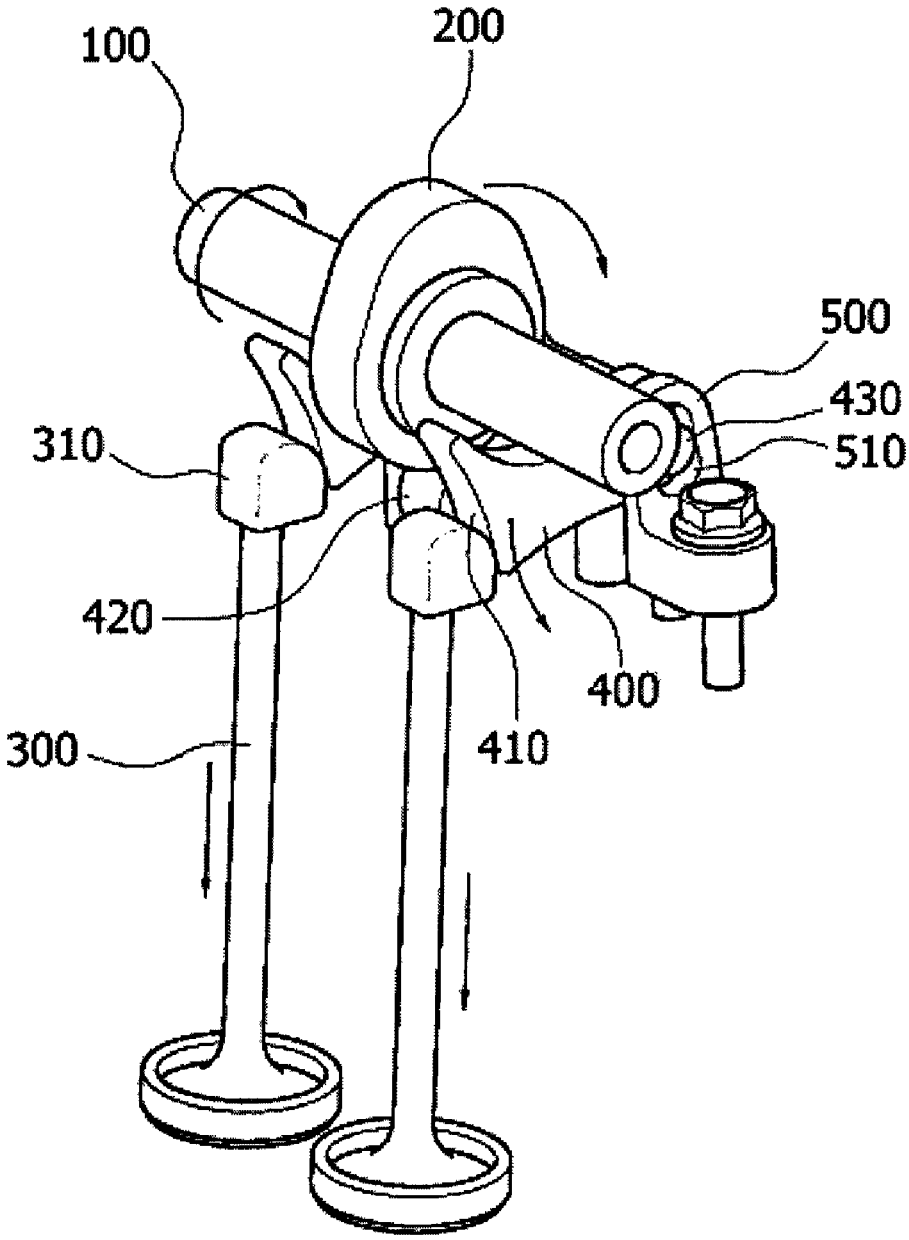
FIG. 2 is a front perspective view illustrating an exemplary CVVA system according to the present invention.
Figure 3:
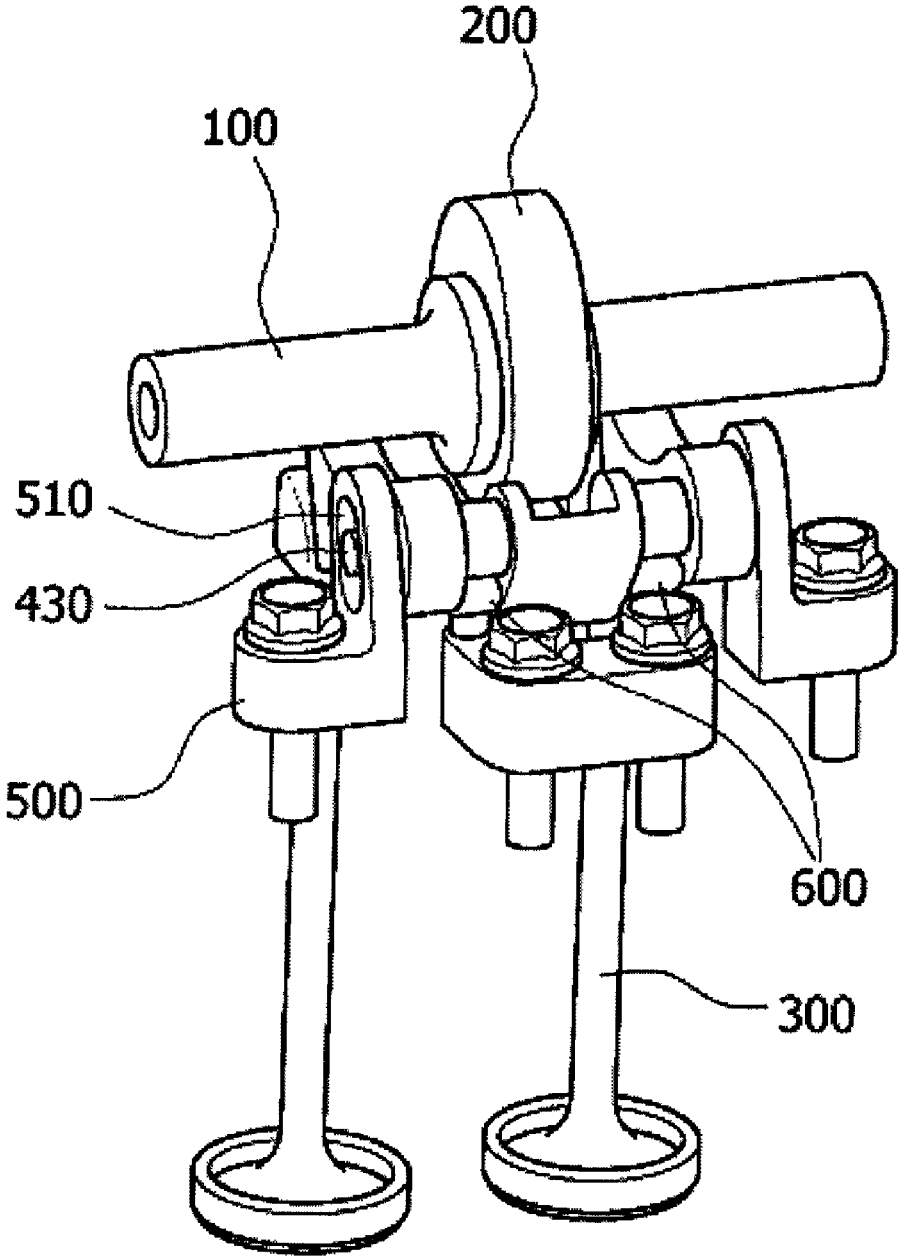
FIG. 3 is a rear perspective view illustrating the exemplary CVVA system according to the present invention.
Figure 4:
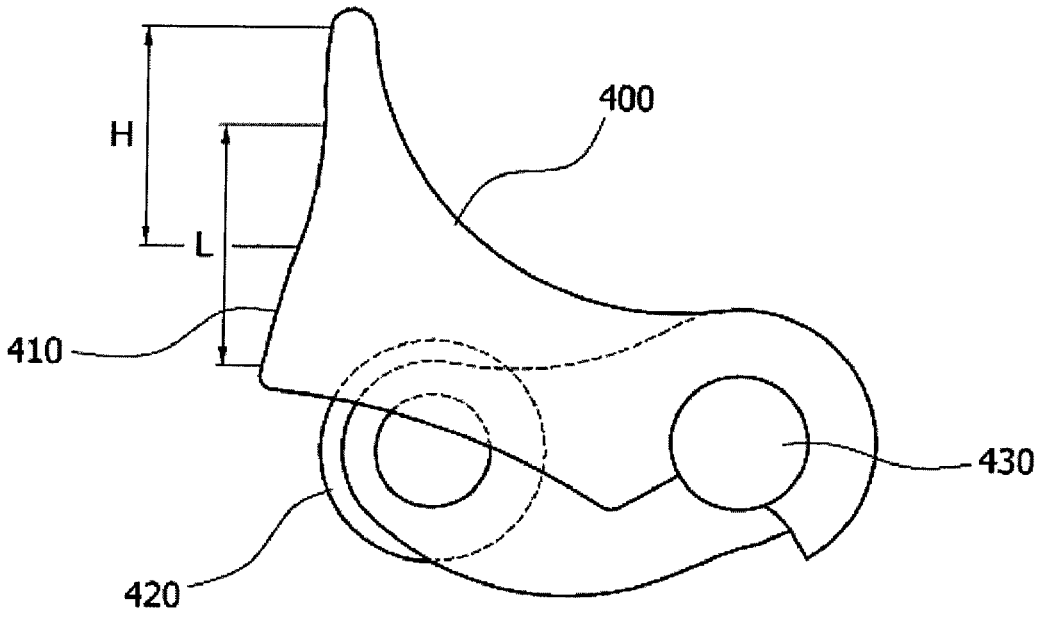
FIG. 4 is a side elevation view illustrating a driven cam in the exemplary CVVA system according to the present invention.

FIG. 2 is a front perspective view illustrating a continuously variable valve actuator (CVVA) system according to various embodiments of the present invention. FIG. 3 is a rear perspective view illustrating the exemplary CVVA system according to the present invention. FIG. 4 is a side elevation view illustrating a driven cam in the exemplary CVVA system according to the present invention.

According to various embodiments of the present invention, the CVVA system includes a driving cam 200 rotated by a driving force transmitted from a crankshaft 100, and a driven cam 400 pressed by the driving cam 200 to be rotated around one end thereof serving as a rotational axle. The driven cam 400 has a cam face 410 at the other end thereof so as to press and open a valve 300 when rotated. Thus, as illustrated in FIG. 2 when the crankshaft 100 is rotated in the clockwise direction, the driving cam fixedly coupled to the crankshaft 100 is also rotated in the clockwise direction. When the driving cam 200 rotates to bring the lobe thereof into contact with the driven cam 400, the driven cam 400 is rotated in the counterclockwise direction around one end thereof (right-hand side of FIG. 2), serving as a rotational axle, and the cam face 410 of the driven cam 400 which is located at the other end thereof (left-hand side of FIG. 2) slides on the top surface of the contact block 310, and thus lowers a contact block 310 provided to the upper end of the valve 300. As the contact block 310 is lowered, the valve 300 is opened.

At this time, the driven cam 400 is characterized by regulating a lift distance of the valve 300 (i.e. a distance by which the valve 300 is pushed in a downward direction when opened) and a lift time of the valve 300 according to the position of the rotational axle thereof, and directly pressing the upper end of the valve 300 in a downward direction when pivoted by the driving cam 200 to thereby open the valve 300.

Figure 1:
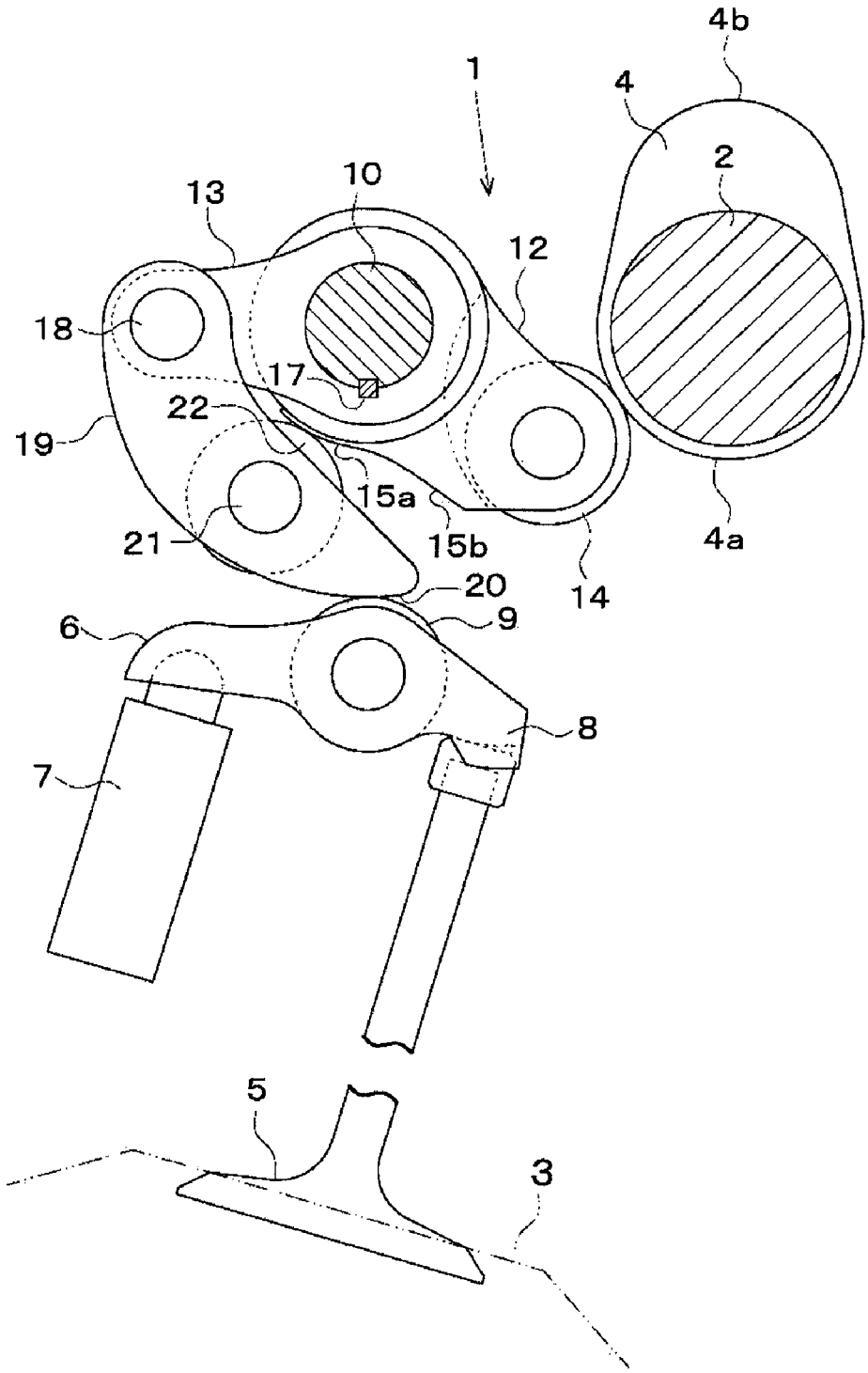
FIG. 1 (Prior Art)
FIG. 1 is a schematic side view illustrating the configuration of a continuously variable valve actuation (CVVA) system of the prior art.

In detail, the conventional CVVA system as illustrated in FIG. 1 is configured so that a driving force of the driving cam 4 is transmitted to the valve 5 through the swing arm 12, variable arm 13, driving arm 19 and rocker arm 6 in turn. In contrast, the CVVA system according to various embodiments may be configured so that a driving force of the driving cam 200 is directly transmitted to the valve 300 through the driven cam 400. In this manner, since the CVVA system according various embodiments has a very simple configuration, it has an advantage in that it can be manufactured easily and inexpensively. Further, since the CVVA system may employ the single driven cam 400 as the constituent part for transmitting the driving force of the driving cam 200, it can more stably transmit the driving force of the driving cam 200 and reduce a possibility of malfunction.

Here, the cam face 410 of the driven cam 400 has two sections that slide on the upper end of the valve 300 to thereby press the valve 300 in a downward direction when the driven cam 400 is rotated. The two sections include a high lift section H where the driven cam 400 allows the valve 300 to move down more than a preset distance when rotated around the rotational axle, i.e. one end, thereof, and a low lift section L where the driven cam 400 allows the valve 300 to move down less than a preset distance when rotated around the rotational axle, i.e. one end, thereof, as illustrated in FIG. 4.

Since the high lift section H is farther from the rotational axle of the driven cam 400 than the low lift section L, particularly since the midpoint of the high lift section H is farther from the rotational axle of the driven cam 400 than that of the low lift section L, the valve 300 is farther lowered when the high lift section H of the cam face 410 pushes the upper end of the valve 300, as compared to when the low lift section L of the cam face 410 pushes the upper end of the valve 300.

In this manner, the structure and principle in which the lowering distance of the valve 300 is varied depending on the height of the rotational axle of the driven cam 400 will be described below in detail with reference to FIGS. 5 through 8.

Further, according to various embodiments of the present invention, the CVVA system further includes an actuator 600 adjusting the height of one end of the driven cam 400 such that the cam face 410 of the driven cam 400 which comes into contact with the valve 300 is limited to the high lift section H or the low lift section L.

The actuator 600 is configured to be raised or lowered by a driving means such as a motor controlled by an electronic control unit (ECU) of the vehicle in contact with the bottom of one end of the driven cam 400. When the actuator 600 is raised, one end of the driven cam 400 is pushed and raised by the actuator 600. In contrast, when the actuator 600 is lowered, one end of the driven cam 400 is also lowered.

In detail, when one end of the driven cam 400 is raised by upward movement of the actuator 600, only the high lift section H of the cam face 410 comes into contact with the contact block 310 of the valve 300, so that the lowering distance of the valve 300 is increased. In contrast, when one end of the driven cam 400 is lowered by downward movement of the actuator 600, only the low lift section L of the cam face 410 comes into contact with the contact block 310 of the valve 300, so that the lowering distance of the valve 300 is reduced.

At this time, when the rotational axle of the driven cam 400 is too excessively raised or lowered, the cam face 410 of the driven cam 400 is separated from the contact block 310 of the valve 300, so that the valve 300 may be abnormally raised or lowered. For this reason, the driven cam 400 has a slide stub 430 protruding from the rotational axle thereof, and a bracket 500 for guiding direction and distance where the slide stub 430 moves is additionally installed.

The bracket 500 is provided with a slot 510 into which the slide stub 430 is slidably inserted. The slide stub 430 can move only within a length of the slot 510, so that the cam face 410 of the driven cam 400 is always kept in contact with the contact block 310.

Further, when the driving cam 200 is configured to slide on a certain part of the driven cam 400, at least one of the driving cam 200 and the driven cam 400 is worn out at its contact part, so that a rotational angle of the driven cam 400 may be changed.

Thus, the driven cam 400 is preferably provided with a roller 420 at the contact part with the driving cam 200. In this manner, since the roller 420 is installed on the driven cam 400, the roller 420 is rotated together when the driving cam 200 is rotated. As such, no wear occurs between the driving cam 200 and the roller 420, so that the rotational angle of the driven cam 400 is kept constant.

Further, in order to allow the cam face 410 to be kept in stable contact with the contact block 310 when the driven cam 400 is rotated, the cam face 410 of the driven cam 400 is preferably curved inwards, while the contact block 310 of the valve 300 is preferably curved outwards. In various embodiments, although the valve 300 is configured so that the contact block 310 thereof comes into contact with the cam face 410 of the driven cam 400, the valve 300 may be configured so that the upper end of the stem thereof comes into direct contact with the cam face 410 without the contact block 310.

Figure 5:
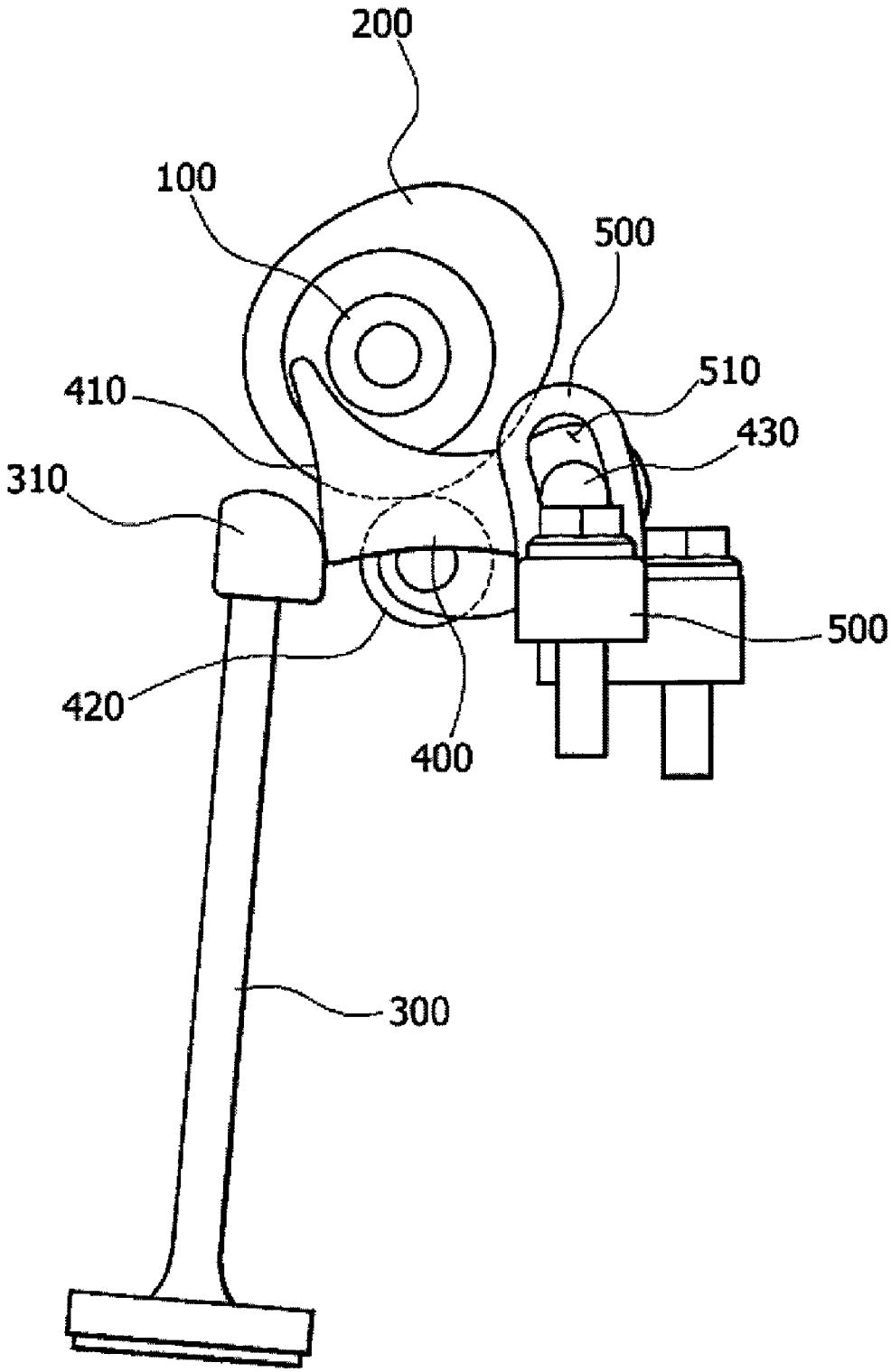
FIGS. 5 and 6 are elevation side views illustrating a low lift in the exemplary CVVA system according to the present invention.
Figure 6:
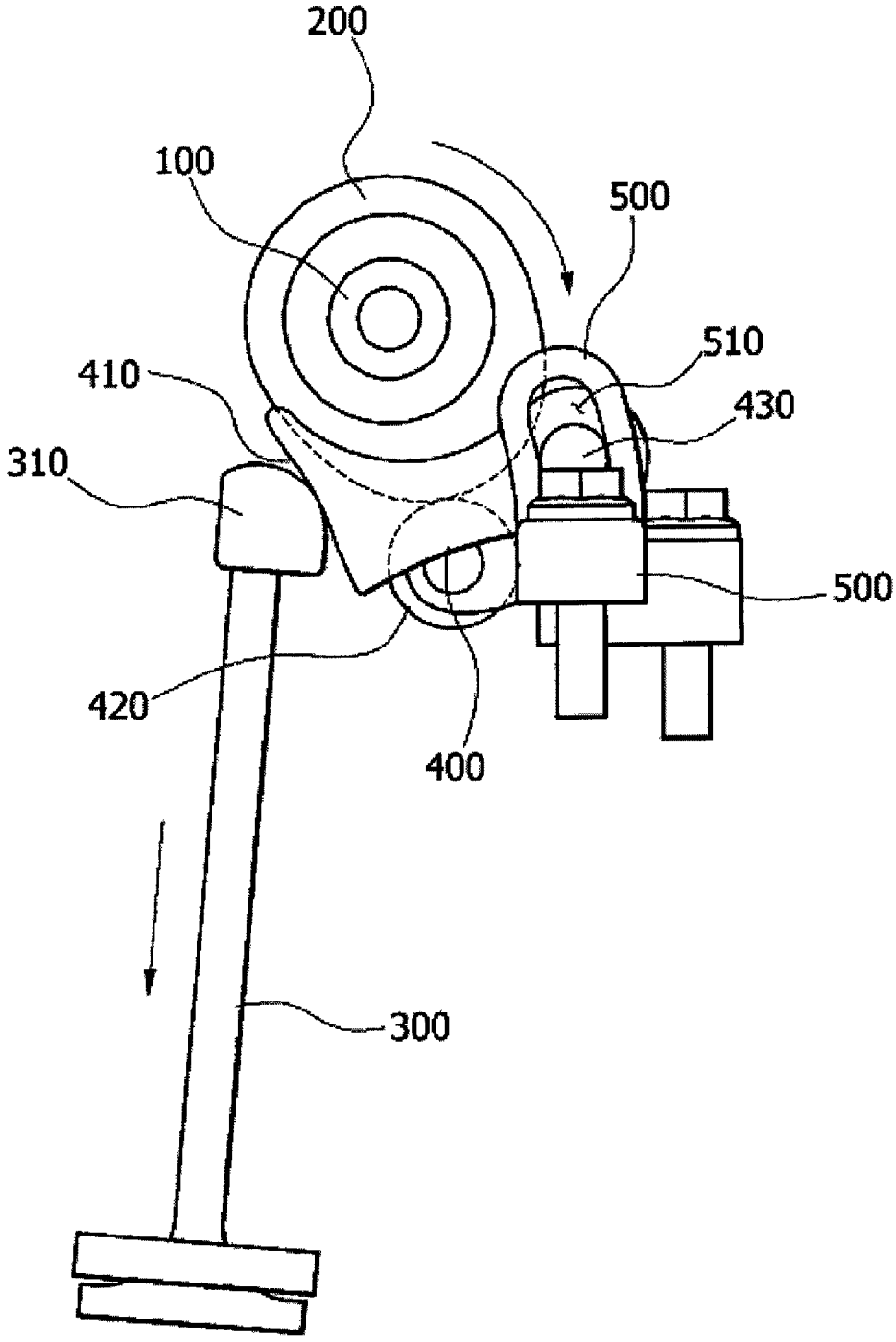
Figure 7:
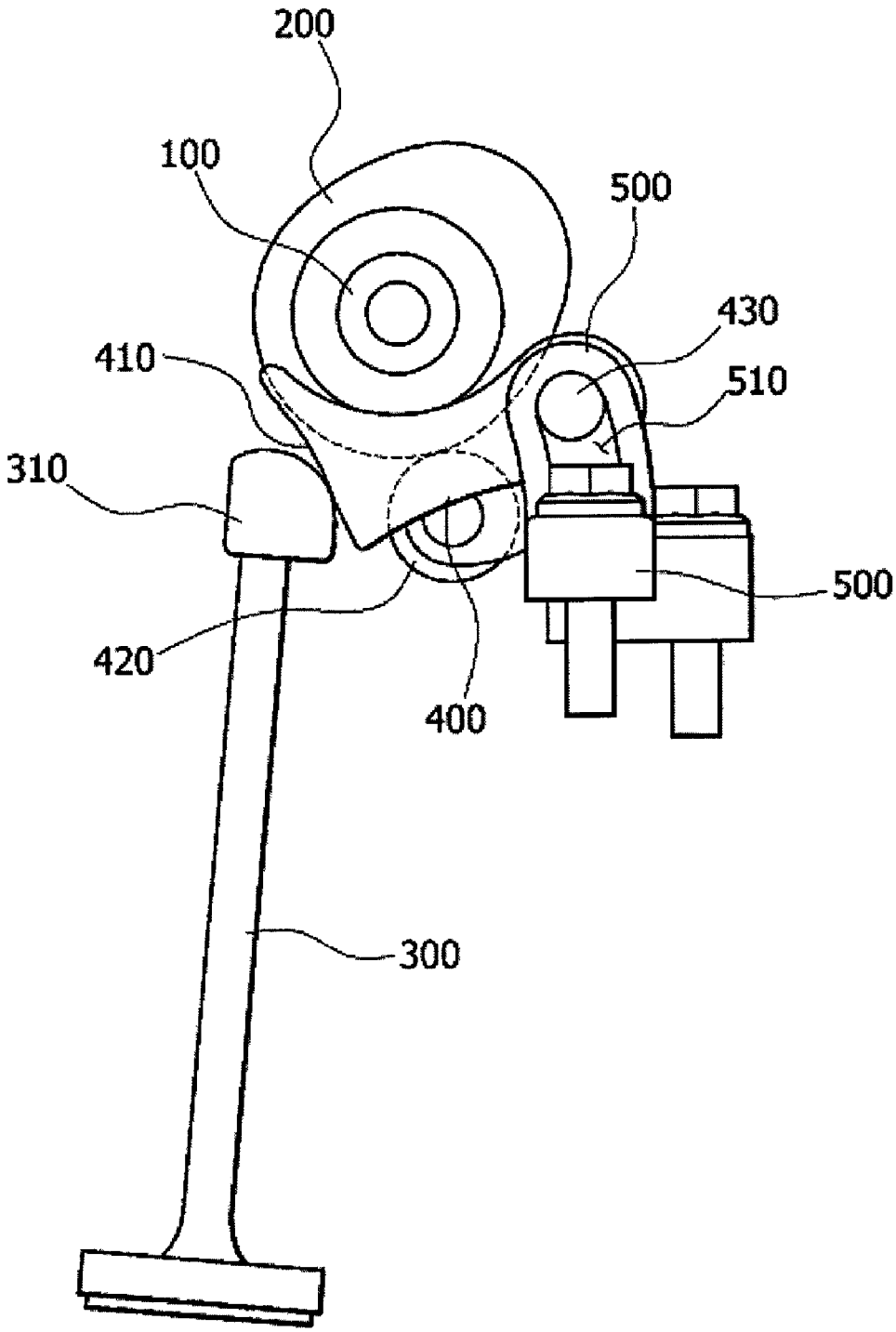
FIGS. 7 and 8 are side elevation views illustrating a high lift in the exemplary CVVA system according to the present invention.
Figure 8:
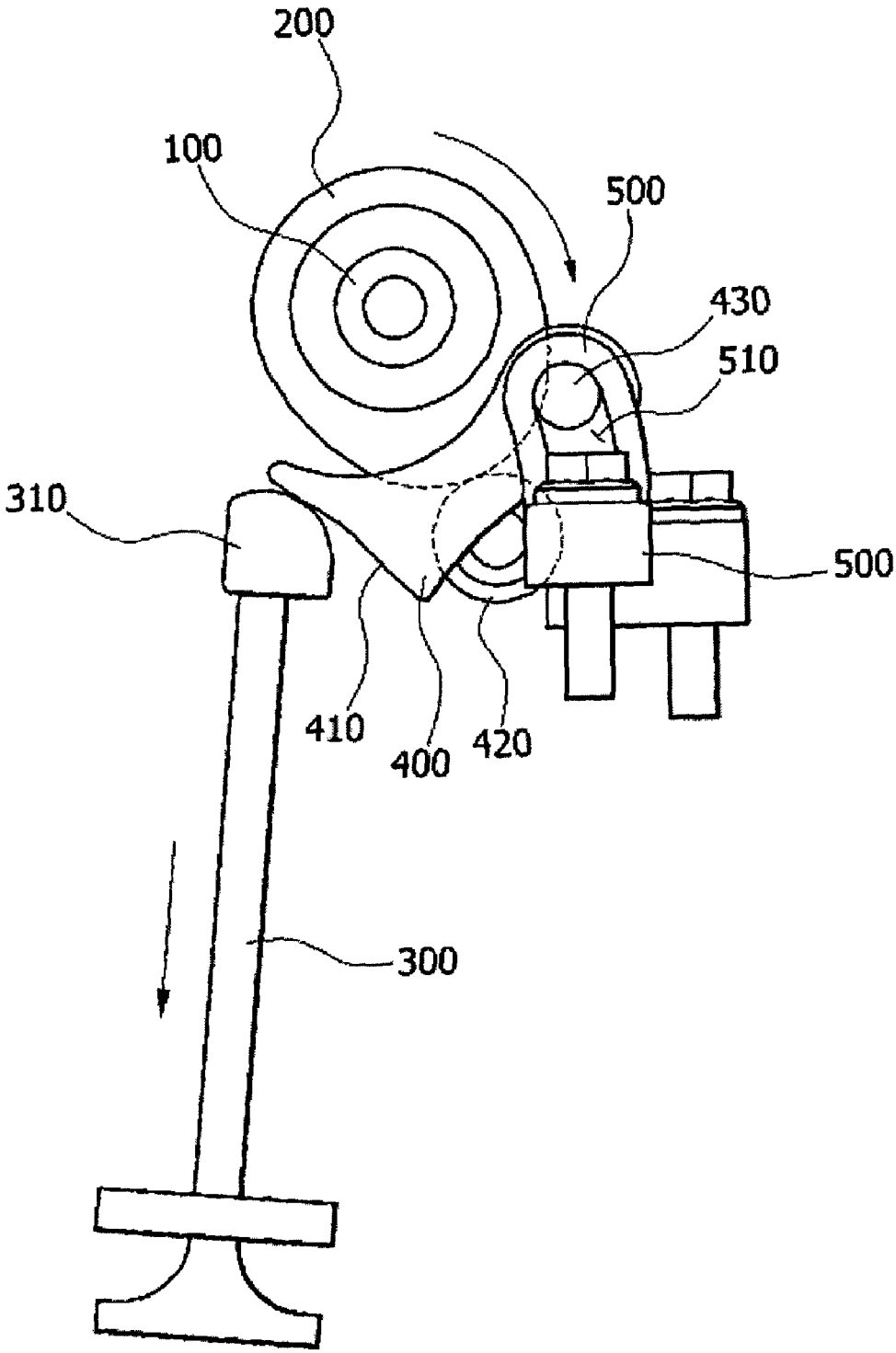

FIGS. 5 and 6 are side elevation views illustrating a low lift in the CVVA system according to various embodiments of the present invention, and FIGS. 7 and 8 are side elevation views illustrating a high lift in the exemplary CVVA system according to the present invention.

In the case in which a short lift distance of the valve 300 is required, the actuator 600 and one end of the driven cam 400 are lowered (see FIG. 3), and thus the slide stub 430 of the driven cam 400 is located on a lower side of the slot 510, as illustrated in FIG. 5.

When the driving cam 200 is rotated at the position illustrated in FIG. 5, the lobe of the driving cam 200 comes into contact with the roller 420. At this time, the driven cam 400 is rotated around the slide stub 430 thereof in the counterclockwise direction, and thus the cam face 410 of the driven cam 400 lowers the contact block 310 of the valve 300.

At this time, only the low lift section L of the cam face 410 comes into contact with the contact block 310 regardless of the rotational angle of the driven cam 400, so that the valve 300 is no longer lowered at the position illustrated in FIG. 6.

In contrast, in the case in which a long lift distance of the valve 300 is required, the actuator 600 and one end of the driven cam 400 are raised, and thus the slide stub 430 of the driven cam 400 is located on the upper side of the slot 510, as illustrated in FIG. 7. At this time, the roller 420 of the driven cam 400 is also raised from the position illustrated in FIG. 5. As such, when the driving cam 200 is rotated, the lobe of the driving cam 200 comes into contact with the roller 420 earlier. Thus, when the driving cam 200 is rotated in the clockwise direction at the position illustrated in FIG. 7, the driven cam 400 is rotated around the slide stub 430 thereof more than the position illustrated in FIG. 6, and the valve 300 is farther lowered, as illustrated in FIG. 8. In other words, the high lift section H of the cam face 410 of the driven cam 400 comes into contact with the contact block 310, so that the valve 300 is lowered more than the position illustrated in FIG. 6.

As described above, the CVVA system can regulate the lift distance of the valve 300 only by raising or lowering one side of the driven cam 400. Further, the CVVA system can advance or postpone the lift time of the valve by properly machining the profile of the cam face 410. This profile of the cam face 410 can be variously modified depending on a shape, a mounting position, etc. of each constituent part, and so a detailed description thereof will be omitted.

For convenience in explanation and accurate definition in the appended claims, the terms "upper", and "downwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve actuation system, comprising:

a driving cam rotated by a driving force transmitted from a crankshaft; and a driven cam pressed by the driving cam to be rotated around a first end thereof serving as a rotational axle of the driven cam, wherein the driven cam has a cam face at a second end thereof so as to press and open a valve when rotated, and wherein a vertical distance between the rotational axis of the first end of the driven cam and a rotational axis of the driving cam is configured to be adjusted by moving a position of the rotational axis of the first end of the driven cam.

2. The continuously variable valve actuation system according to claim 1, wherein the cam face includes a high lift section where the driven cam allows the valve to move more than a preset distance when rotated around the first end thereof, and a low lift section where the driven cam allows the valve to move down less than the preset distance when rotated around the first end thereof.

3. The continuously variable valve actuation system according to claim 2, wherein the high lift section has a midpoint farther from the rotational axle of the driven cam than that of the low lift section toward the driving cam.

4. The continuously variable valve actuation system according to claim 2, further comprising an actuator configured to press the first end of the driven cam for adjusting a height of the first end of the driven cam such that the cam face contacting the valve is limited to one of the high lift section and the low lift section regardless of an rotational angle of the driven cam.

5. The continuously variable valve actuation system according to claim 1, further comprising a bracket wherein the driven cam includes a slide stub protruding from the rotational axle thereof and is slidably inserted into a slot formed on the bracket so as to limit a range within which a height of the driven cam is adjusted.

6. The continuously variable valve actuation system according to claim 1, wherein the driven cam includes a roller at a portion thereof which comes into contact with the driving cam.

7. The continuously variable valve actuation system according to claim 1, wherein the cam face is curved inwards, and an upper end of the valve is curved outwards at a part thereof which comes into contact with the cam face.

8. The continuously variable valve actuation system according to claim 1, further including a contact block formed an upper portion of the valve, wherein the cam face is curved inwards and an upper end of the contact bracket is curved outwards at a part thereof which comes into contact with the cam face.

* * * * *